US005341626A

United States Patent [19]

Beckmann

[11] Patent Number: 5,341,626

[45] Date of Patent: Aug. 30, 1994

[54] CARTONING METHOD AND APPARATUS

[75] Inventor: Harald Beckmann, Gevelsberg, Fed. Rep. of Germany

[73] Assignee: Maschinenfabrik Alfred Schmermund GmbH & Co., Gevelsberg, Fed. Rep. of Germany

[21] Appl. No.: 40,122

[22] Filed: Mar. 30, 1993

[30] Foreign Application Priority Data

Apr. 1, 1992 [DE] Fed. Rep. of Germany ..... 4210813

[51] Int. Cl.[5] ..... B65B 43/60; B65B 43/50; B65B 43/30

[52] U.S. Cl. ..... 53/566; 53/574

[58] Field of Search ..... 53/566, 376.5, 376.4, 53/574, 575, 377.2

[56] References Cited

U.S. PATENT DOCUMENTS 2,694,350 11/1954 Malhiot ..... 53/566 X
2,881,682 4/1959 Engleson et al. .
2,973,611 3/1961 Engleson et al. ..... 53/566 X
3,300,946 1/1967 Martin ..... 53/566 X
3,478,487 11/1969 Smith et al. .
4,258,526 3/1981 Focke ..... 53/566 X
5,027,586 7/1991 Ramaker ..... 53/566 X

FOREIGN PATENT DOCUMENTS 2058949 12/1970 Fed. Rep. of Germany .

*Primary Examiner*—Horace M. Culver
*Attorney, Agent, or Firm*—Chilton, Alix & Van Kirk

[57] ABSTRACT

The packaging of articles grouped to form generally cuboid shaped package contents of variable dimensions includes the erection of carton blanks to form open-ended tubular receivers, insertion of the grouped articles into such an erected carton and folding and glueing end flaps to close the carton about the article group. The filling of the cartons with the article groups and the closing of the cartons takes place on a turret having cells which are adjustable in size to match the incoming erected carton.

20 Claims, 2 Drawing Sheets

CARTONING METHOD AND APPARATUS

BACKGROUND OF THE INVENTION

1. Field of the Invention

The present invention relates to the packaging of articles in sealed cartons and particularly to the enclosure, within a carton, of pre-formed groups of articles which cooperate to define a generally cuboid shape which may vary in width and/or height from group-to-group. More specifically, this invention is directed to apparatus for erecting cartons which may vary in format, subsequently inserting articles to be packaged in such cartons and thereafter closing the cartons, and the invention is especially concerned with apparatus of such character which may be quickly and easily adjusted to process carton blanks selectable from plural supplies in accordance with the configuration of the articles being packaged. Accordingly, the general objects of the present invention are to provide novel and improved methods and apparatus of such character.

2. Brief Description of the Prior Art

While not limited thereto in its utility, the present invention is particularly well suited for use in the packaging of cigarettes. A given manufacturing facility may produce cigarettes which, when formed into packages, have several different configurations when considered from the viewpoint of package length, width and height. Such packages are formed into groups, for example for packaging and subsequent sale as multi-pack cartons, and the groups thus also have different dimensions. A packaging facility wherein the apparatus which forms the cartons is suitable for only a single format, or which can be changed to accommodate different carton formats only with considerable difficulty, is thus inefficient.

For an example of a prior art cartoning system, reference may be had to U.S. Pat. No. 3,478,487. The apparatus of this patent receives, as raw material, a carton blank which is in a flat configuration. This carton blank is first cut to the required size and then erected. During the erection operation, a side wall of the carton will be caused to move to an out-of-the-way position so that a stack of products to be packaged can be pushed into the carton interior through the open side wall area.

SUMMARY OF THE INVENTION

The present invention relates to a method of, and associated apparatus for, reliably and efficiently cartoning pre-formed groups of articles. A particularly unique feature of the present invention is its ability to employ carton blanks having different formats, i.e., blanks which define internal carton volumes of different size and shape when erected.

Apparatus in accordance with a preferred embodiment of the invention, in the interest of maximizing operational speed, employs a turret having plural cells which receive the erected carton blanks. These cells are open in axial directions which are parallel to the axis of rotation. The turret, and thus the open-ended cells, is caused to rotate, in step-wise fashion, about a horizontal axis. The erected carton blanks delivered into the cells of the turret are characterized by being closed in the side-wall region, i.e., the erected carbons are open only on the oppositely disposed ends. The carton-receiving cells are defined by cooperating adjacent pairs of movable and stationary walls such that the height and width dimensions of the cells may be readily changed. Means are associated with the turret to cause the application of an adhesive to the end flaps of the carton blank and to fold the end flaps to close the cartons after a group of articles have been inserted therein. The adhesive applicators and the end flap folding elements are also relatively adjustable to accommodate the carton blank format.

The present invention allows groups of articles having different formats to be cartoned utilizing a single apparatus and, accordingly, the cartoning apparatus may be used to its maximum capacity. The apparatus of the invention is characterized by simple, rapid and largely automatic adjustability to adapt to different carton formats.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in the two figures and in which.

DESCRIPTION OF THE DISCLOSED EMBODIMENT

Figure 1:
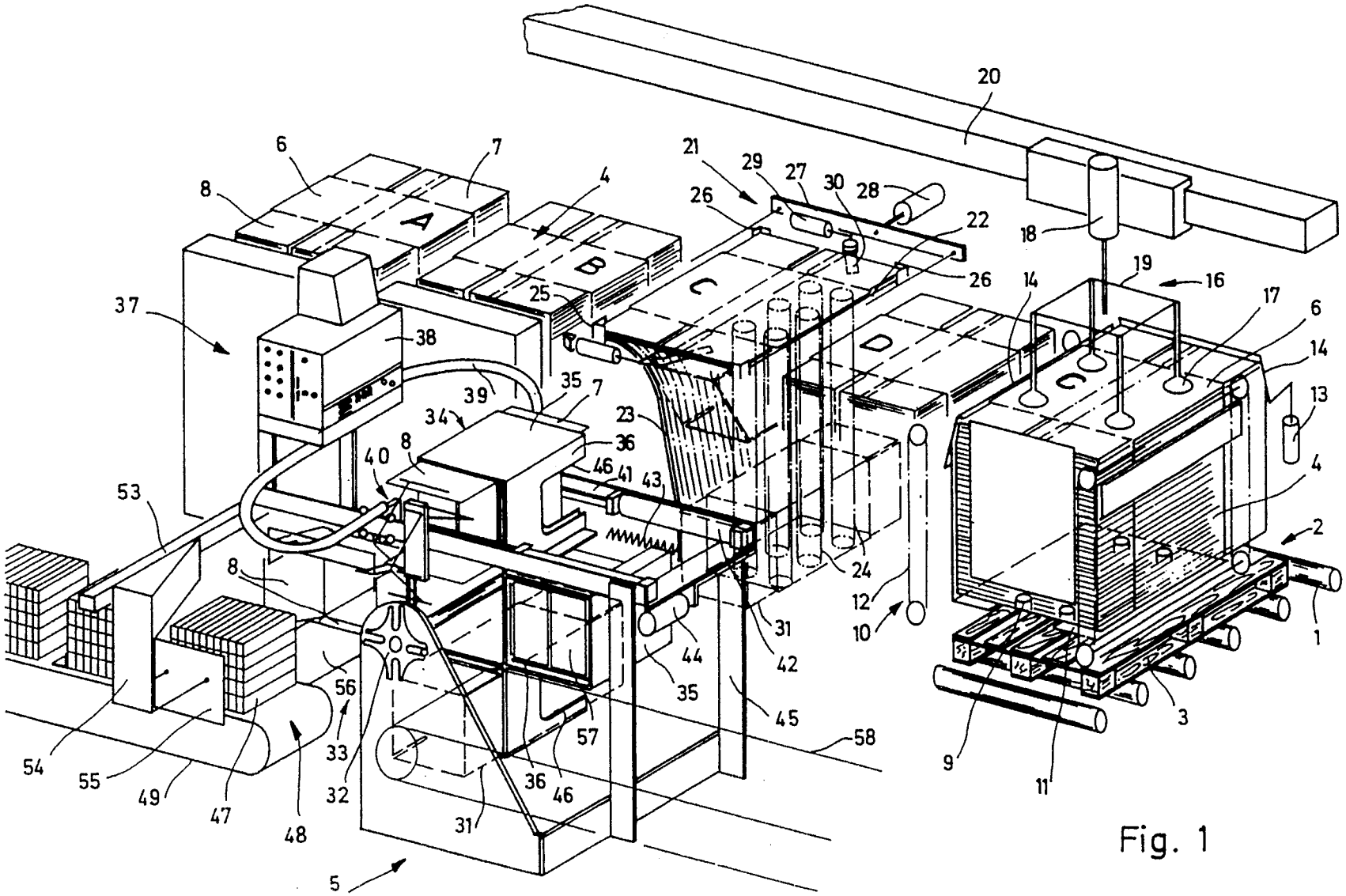
FIG. 1 is a schematic perspective view of a first embodiment of apparatus in accordance with the invention for erecting, filling and sealing cartons.

In the practice of the present invention, stacks of carton "blanks" 4 are received from a feed conveyor system, not shown. The blanks 4 will be of two-layer construction, i.e., the blanks will be flattened cartons which will be erected, filled and closed in the manner to be described below. The stacks of carton blanks are supported on pallets 3 and are transferred from the feed conveyor onto one of a plurality of parallelly arranged roller tables 2. The tables 2 each include a plurality of rollers 1 and at least some of these rollers are drivable, by means which has not been shown, to move a pallet to a blank extraction position. Accordingly, the tables 2 will move the pallets 3 to a position where they are situated adjacent to the feed side of a multi-format cartoner, indicated generally at 5, the cartoner including an erection station 21 and a filling/closing station.

The two-layer blanks 4 from which the cartons are to be formed have a generally rectangular shape and are provided with fold lines and slots. The fold lines and slots define a carton side-wall forming region 6 and lid and bottom flap forming regions 7, 8 which extend outwardly from the side-wall region. The side-wall forming region 6 will have previously been partly coated with an adhesive and closed on itself so that it may be erected to form a flat-walled tube having a rectangular cross-section. Restated, the side-wall region 6 will include a joint whereby the two layers of the blank 4 are continuous in a first direction.

As the pallets 3 are delivered to the feed position for the erecting station, the blanks 4 are arranged with either the lid or the bottom flap forming regions facing the erection station 21. As the invention is depicted in FIG. 1, four stacks of carton blanks A, B, C and D, which may differ from stack-to-stack in respect of the printing on and/or the formats of the blanks 4, are positioned such that individual blanks can be withdrawn therefrom. The order of arrangement of the stacks A, B, C and D is not relevant to the practice of the invention. The pallets will, however, typically be arranged in accordance with the demand for the particular carton blanks 4 with the stack(s) of blanks having the highest consumption rate being located closest to the erection station.

Lifting rams 9 are provided beneath each of the roller tables 2. The rams 9, when activated, will raise a complete stack of carton blanks 4 from a pallet 3 such that the stack may be engaged by a lift, one of the lifts having been indicated generally at 10. The lift 10 engages the underside of the stack, or a partial stack, along two opposite sides by means of a pair of parallel supporting members 11 which have a wedge-shaped leading edge. The position of the members 11 is vertically adjustable, via chain drives or toothed belts 12 which are connected thereto, in order to insure that the uppermost blank of the stack of blanks supported on members 11 will always be brought to the same level regardless of the number of carton blanks 4 which comprise the stack or are extracted from the stack on a pallet.

When all of the carton blanks 4 have been lifted from a pallet, i.e., when support for the stack of blanks or the last portion of a stack of blanks has been transferred to the lift 10, the rams 9 are retracted and the empty pallet 3 removed by reversing the transport direction of the table 2.

As a stack of blanks is raised, it will engage pivotal stops 14 and cooperating fixed stops 15, stops 14 being caused to pivot in the direction of the stack by means of fluidic actuators such as actuator 13. The pivotal stops 14 engage, in the disclosed embodiment, two adjacent edges of the stack while the oppositely disposed fixed stops 15 contact the two remaining edges of the stack. The pivotal stops 14 urge the carton blanks 4 at the upper end of the stack against the fixed stops 15 as a result of the pivotal force provided by actuator 13. This inwardly directed force results in the carton blanks 4 at the top of the stack being properly positioned and being partially arched, i.e., the cartons at the top of the stack will be displaced relative to one another so that there is some separation between adjacent blanks and the blanks are thereby easier to grasp and extract from the top of the stack.

In order to individually remove carton blanks 4 from a stack supported by a lift 10, a gripping device indicated generally at 16 is provided. The gripping device 16 is movable along a horizontal rail 20 and includes an extracting head 19 which is provided with a plurality of suction devices 17. The extracting head 19 is vertically movable via a drive 18.

The extraction device 16 picks up the uppermost carton blank 4 from a stack and transfers that blank to erecting station 21. The erecting station 21 is provided with a pair of side walls 22 and 23. The walls 22 and 23 cooperate to define a shaft which narrows in the downward direction. To this end, in the disclosed embodiment, wall 22 is flat and vertical while wall 23 is oriented generally horizontally at its upper end and evolves, i.e., rotates about a corner region, into a downward extending wall which is obliquely oriented with respect to wall 22. At the bottom of the shaft defined by walls 22 and 23, the separation between the walls will be caused to correspond approximately to the width of the carton which is to be formed. Vacuum devices 24, which are vertically movable in the shaft defined by walls 22, 23, engage a single side wall defining area disposed within region 6 of a carton blank 4 and draw the blank downwardly into the shaft. Thus, through the combined action of the vacuum grippers 24 and the converging shaft defined by plates 22,23, a two layer carton blank 4 delivered to the top of the erecting device 21 is pulled downwardly and, as a result of the downward motion, folded to form an open-ended, cuboid shaped receiving space, i.e., a rectangular tube, which is open toward the lid and bottom flap forming regions 7, 8 of the blank 4.

A carton blank 4, as delivered to the erecting device 21, is substantially horizontally disposed and is supported by the vertically movable vacuum devices 24 and the horizontally oriented upper end portion of wall 23. In the interest of insuring that the blank will be properly positioned for folding in accordance with the preformed fold lines, locating devices in the form of angle members 25 are provided. Members 25 engage at least the two corners of the blank which are disposed closest to the downstream filling/closing station. In order to accommodate different format carton blanks, the location of the surface which supports the blanks prior to their being drawn downwardly can be varied by moving wall 23 relative to vertical wall 22. The wall 23 may, in fact, be slightly resiliantly biased toward wall 22 by means of a compression spring 43 whereby the width of the shaft of the erecting station 21 is to some degree self-adjusting. Additionally, or as an alternative, a pair of further corner locating angle members 26 may be employed. The spacing between members 25 and 26, when all four corners are contacted by locating members, will be variable by means of adjusting the position of a horizontally movable setting plate 27, plate 27 being coupled to an actuator 28.

The erecting station 21 is provided with pivotal support arms 30 which may be rotated inwardly, i.e., toward the center of a carton blank 4, by means of fluidic actuators 29. The support arms 30 prevent the bottom and lid flaps 7,8 of the carton blank from being bent downwardly when the blank is delivered to the erecting device. The support arms 30 and their actuators 29 are connected to the setting plate 27 and thus are adjustable as a function of the carton-blank length.

The carton blanks 4, as depicted in FIG. 1, are conventionally provided with slots between the lid flaps 7 and between the bottom flaps 8. The centrally located of the slots between the two lid flaps and between the two bottom flaps on a first layer of the two layer blank is offset relative to the slots in the other layer of the flattened carton blank. In the case of carton blanks which define an article receiving volumn having a cross-section which is other than square, which is the usual operating condition and is the situation illustrated in FIG. 1, it may be necessary or desirable to pivot the support arms 30 into the slots in the flap forming regions of the carton blanks so that only the upper layer of the blank 4 is supported in the flap regions. Accordingly, when pivoted, the support arms 30 will contact only the upper layer of the blank. This mode of operation insures proper opening and reliably prevents the carton blank from kinking during the erecting operation.

Additionally, or as an alternative, the operation of the suction devices 17 of the extraction head 16 can be synchronized with the operation of vacuum devices 24 so as to delay release of the blank by devices 17 until after the downward motion of the vacuum devices 24 begins. This will result in the two layers of the carton blank being pulled apart at the beginning of the erecting operation. This delayed termination of the influence of extraction head 16 is particularly useful in the case of carton blanks which define content receiving areas having a square cross-section.

Although there are means other than the disclosed erecting station 21 which could be employed to erect a two layer carton blank, the above-described erecting device is particularly well suited for use in the practice of the present invention because of its exceptional ability to cooperate with the filling/closing apparatus in an uninterrupted feed cycle which includes movement of the carton blank in the vertical direction during erection.

A carton blank which has been erected in station 21 is indicated at 31. The transfer of this tubular, partially completed carton from the erecting station 21 to the filling/closing station is accomplished by means of a transfer device, not shown, which may be a reciprocal pusher plate. During this transfer the lower edge of the vertical wall 22 functions as a guide.

The carton filling/closing station is designed as a turret, indicated generally at 33, which is provided with a stepping drive 32. The turret 33 has a plurality of cells 34 which are open in the axial direction. In the disclosed embodiment, the turret employs four cells 34 which are offset relative to one other by 90°. The cells 34 of turret 33 each possess two adjacent stationary walls 35 and two adjacent movable walls 36, the movable walls 36 being individually displacable toward or away from oppositely disposed of the stationary walls 35. The movement of the cell walls, to adapt the receiving space of each cell to the cross-sectional format of the erected carton blank 31 which is to be received, is accomplished by means of a servo-drive. In the disclosed embodiment, the movable cell walls 36 are spring biased in the inward direction, i.e., toward an oppositely situated fixed wall, and thus accommodate a small amount of play, i.e., approximately 2 to 3 mm, in order to compensate for variations in the dimensions of the cartons. This self-adjustment of the size of the cells 34 can, for example, be accomplished by designing the movable cell walls 36 as double walls with intermediate compression springs. It should also be noted that, in the disclosed embodiment, the receiving position of a cell 34, i.e., the position where a cell 34 will be located when a carton is pushed therein from the erecting station 21, is the lowermost position as the turret rotates in stepwise fashion.

The filling/closing station also comprises an adhesive applicator, indicated generally at 37, which includes a heated reservoir 38. Hot glue is fed from reservoir 38 to a pair of adhesive applicator heads 40 via feed conduits 39. The applicator heads 40 are movable along parallel rails 41 which, in the disclosed embodiment, are arranged horizontally. Movement of the heads 40 is produced by means of an actuator 42. One of rails 41 will be stationary while the opposite rail is adjustable, by means of an actuator 44, to vary the spacing between the heads 40 as a function of the format of the carton being formed.

An oppositely disposed pair of the cell walls 35, 36 are provided with cutouts 46 which face in the direction of the movable rail 41. Because of the presence of the cutouts 46, the cell walls 35, 36 do not impede the adhesive application operation even when the length of the carton being formed is less than the axial length of the cells 34.

Figure 2:
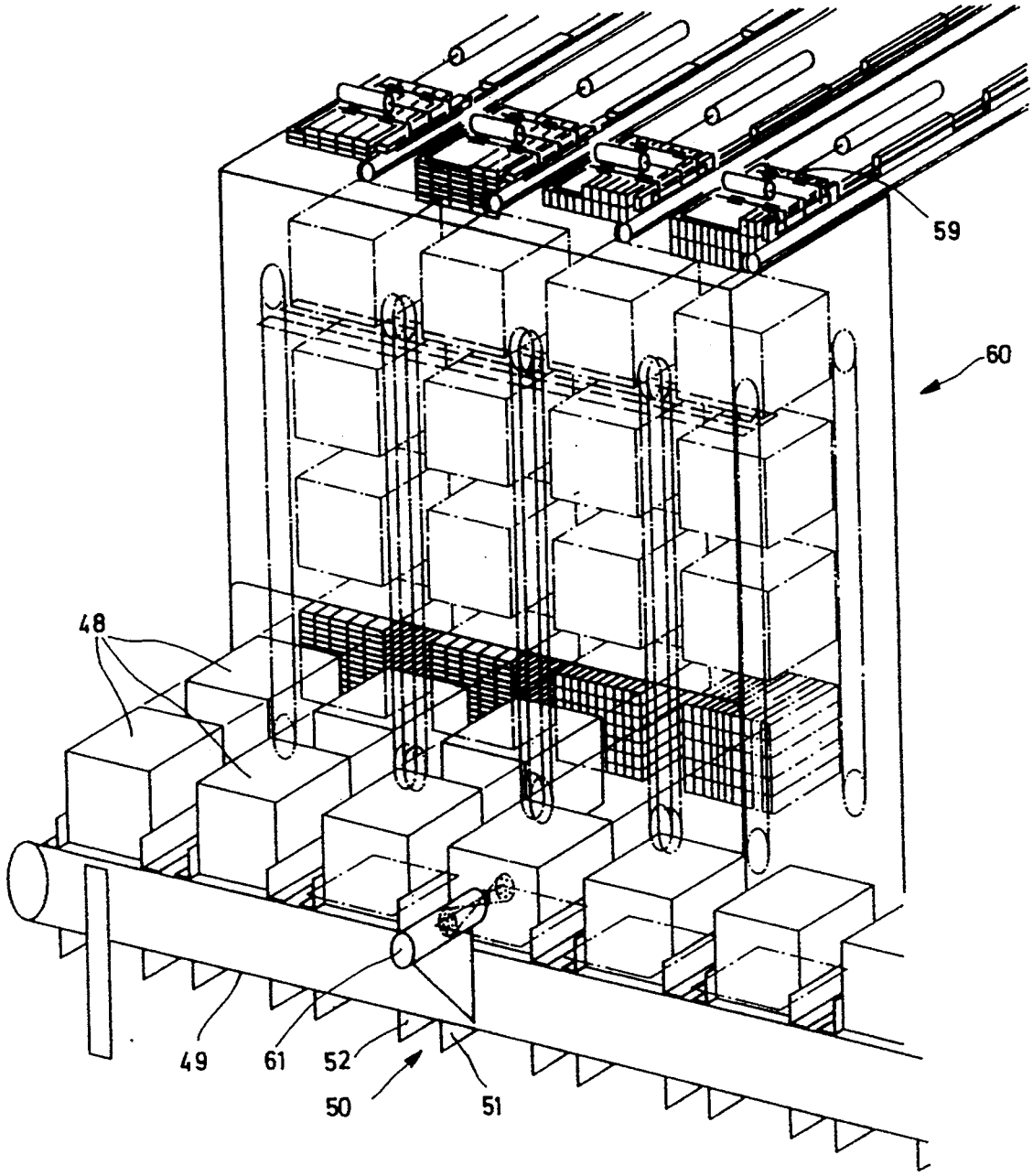
FIG. 2 is a schematic perspective view of apparatus for temporarily storing grouped articles which are to be cartoned, the groups having a plurality of different formats, and conveying the groups singly to the apparatus of FIG. 1.

Referring jointly to FIGS. 1 and 2, articles 47 to be packaged are delivered to the cartoner 5 by means of a conveyor which includes a belt 49. The articles travel on conveyor 49 as preformed groupings or stacks 48. The conveyor belt 49 is provided with separators, indicated generally at 50, which are defined by walls 51, 52. When a stack 48 located between a pair of walls on the conveyor arrives at the delivery end of the conveyor, the stack will be in registration with a cell 34 of the turret 33. In the disclosed embodiment, the trailing end walls 51 of the separators 50 of conveyor belt 49 are fixed in position. When a stack 48 being delivered on conveyor belt 49 moves into alignment with a cell 34 of turret 33, the fixed wall 51 of the stack separators on the belt will be in alignment with a fixed wall of the cell 34 located at the receiving position. As will be obvious to those skilled in the art, the walls 52 could be eliminated from the conveyor and, in such case, it would typically be desirable to align the stack 48 by urging it against wall 51 before the stack is transferred into a cell 34.

A slide arm 54, movable along a rail 53 which extends transversely relative to the longitudinal direction of conveyor belt 49, is positioned adjacent to the end of belt 49. A pusher plate 45 is mounted on the end of arm 54. Upon actuation of the slide arm 54, the plate 55 will push a stack 48 over a bridging plate 56 and into an erected carton blank 32 located within the cell 34 in the receiving position. The carton flaps, i.e., the lid or bottom flaps 7 and 8, which face in the direction of slide plate 55 may, if necessary or desirable, be at least partially deflected outwardly with respect to the interior of the carton by gripping devices, now shown, during the transfer operation in order to insure that the flaps do not impede the insertion of the stack 48 into the erected carton blank 32.

The slide plate 55 can be of adjustable size so that it may be matched to the size of the stack 48 which is to be pushed into an erected carton blank 32. Obviously, the minimum size and shape of slide plate 55 will be determined by the cross-section of the smallest erected carton blank 32 which is to be filled.

During rotation of turret 33, the cell 34 which contains an erected carton blank 32 filled with a stack of articles 48 will, upstream of the adhesive applicator heads, move into engagement with folding elements which have not been shown in the drawing in the interest of facilitating understanding of the invention. Two of these folding elements are stationary relative to the rotating cell 34 and thus fold the inner bottom and lid flaps which are first encountered during rotation, i.e, the leading flaps. The direction of folding is, of course, toward the stack 48, and the folding thus proceeds in a direction opposite to the direction of turret rotation in the sense of the movement of the flap outer edges. A pair of further pivotal folding elements will engage the trailing bottom and lid flaps 7, 8 downstream of the adhesive applicator heads and fold these flaps down onto the stack 48. The folding elements which are located on the side of the turret where adjustable rail 41 is located will be adjustable, relative to oppositely disposed stationary folding elements, as a function of the format of the carton. The cut-outs 46 in the cell walls 35, 36 permit the folding elements to penetrate into the cells so as to completely fold the flaps of a short carton. Folding elements of the type being described are well known in the cigarette packaging art where they are employed in conjunction with indexable wrapping turrets which are employed in the formation of individual cigarette packages.

As noted above, after the folded-in inner bottom and lid flaps 7,8 have been coated with adhesive, i.e., during further indexing of turret 33 in the clockwise direction as the apparatus is depicted in FIG. 1, the outer bottom and lid flaps 7,8 are folded down onto the adhesive coated inner bottom and lid flaps. Accordingly, a completed carton 57 will be present in the cell 34 of turret 33 which reaches the discharge position, i.e., a position where the cell contents may be pushed out onto a further conveyor 58. The emptying of a completed carton 57 from a cell is accomplished by means of a slide mechanism, not shown.

Referring to FIG. 2, stacks 48 having a format which depends upon the particular product, for example the particular brand of cigarettes, may be stored in a collecting elevator which has been indicated generally at 60 in FIG. 2. The elevator 60 thus contains columns of these stacks 48, these stacks being delivered to the columns of the elevator via slides 59 which are operated by fluidic actuators. The stacks are released from the elevator onto the conveyor belt 49, i.e., are deposited between the separator walls 51, 52. The physical characteristics of the stacks 48 which are to be cartoned can be detected via a reader 61, and the appropriate carton blank 4 will then be fed to the multi-format cartoner 5 at the appropriate time so that both the stack and erected carton blank will simultaneously arrive at the position where the stack is to be inserted into the erected carton.

It is possible that a condition may occur wherein the adhesive coating of the two-layer carton blanks 4 in the side-wall region 6 will result in an increase in carton blank thickness. Under such circumstances, in the interest of stability, it may be necessary to stack the carton blanks 4 so that alternate blanks in the stack are rotated 180° relative to one another. Under such circumstances, the device 16 which extracts the blanks from a stack on a pallet can be rotatable so that all of the blanks 4 will be fed to the erecting device 21 with the same orientation.

The tables on which the pallets 2 are arranged, supporting the stacks of blanks 4 waiting for individual carton blanks to be extracted therefrom, need not be in the side-by-side orientation as depicted in FIG. 1. For example, the pallets may be supported at least partly one above the other.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In apparatus for packaging articles within a package volume having a generally rectangular cross-section, the package being formed from a carton blank having a continuous side-wall defining region and integral bottom and lid flaps extending outwardly therefrom, improved apparatus for filling and closing the carton blanks comprising:

a rotary turret, said turret having a plurality of receiving cells, said receiving cells being of generally rectangular cross-sectional area and being open at a pair of opposite ends, said cells each defining an axis and said ends being disposed along said axis, a pair of adjacent walls of each of said cells being fixed in position and a second pair of adjacent cell defining walls being adjustable relative to oppositely disposed of said fixed walls whereby the width and height of said cells may be varied as a function of the format of a carton blank;

means for causing said turret to rotate about an axis, said rotation causing means producing step-wise motion of said turret;

means for erecting a carton blank to a tubular configuration having the carton end flaps extending outwardly at a pair of oppositely disposed open carton ends;

means for inserting an erected carton blank in a cell of said turret at a first position of said turret;

means for transferring articles to be packaged into an erected carton blank disposed in a cell of said turret;

means located adjacent to said cell open ends along the path of motion thereof during rotation of said turret for folding the bottom and lid flaps of an erected carton blank inwardly to a closed position;

means located adjacent to said cell open ends for applying adhesive to selected of said bottom and lid flaps of an erected carton blank, said adhesive applying means being located at a second position of said turret; and means for varying the spacing between oppositely disposed of said flap folding and adhesive applying means as a function of the carton blank format.

2. The apparatus of claim 1 wherein the position of said adjustable cell walls is variable by means of a servo-drive.

3. The apparatus of claim 1 wherein said adjustable cell walls are resiliently biased in the inward direction, the amount of wall movement in response to said resilient bias being limited.

4. The apparatus of claim 1 wherein a pair of oppositely disposed of said cell walls are provided with cutouts through which portions of said adhesive applying means may pass during rotation of said turret.

5. The apparatus of claim 1 wherein said means for erecting a carton blank comprises:

erecting shaft defining means, said shaft defining means having a first vertical wall and a second wall displaced from said first wall and extending obliquely with respect thereto, the gap between said walls at a first end of shaft defined thereby being commensurate with the width of a side of the carton being formed and said gap enlarging in the direction of the opposite end of the shaft; and means for engaging a flattened carton blank supported at said opposite shaft end and drawing said blank downwardly to the bottom of the shaft, the flattened carton blank being forced to assume an erected tubular shape by said downward motion between the converging shaft walls.

6. The apparatus of claim 5 wherein said erecting means further comprises:

means for supporting a carton blank above said shaft defining means, said supporting means having a configuration which is adjustable as a function of the format of the carton blank format.

7. The apparatus of claim 5 wherein the space between said first and second walls of said shaft defining means is adjustable.

8. The apparatus of claim 5 wherein said erecting means further comprises:

at least a pair of pivotal support arms, said support arms being movable into a position to engage oppositely disposed bottom and lid flap defining regions of a carton blank supported over said shaft.

9. The apparatus of claim 1 further comprising:

means for delivering carriers supporting a stack of carton blanks to said erecting means, said delivering means including:

means for lifting a stack of carton blanks from a carrier; and means for withdrawing the uppermost carton blank in the stack from said lifting means and transporting the thus withdrawn carton blank into registration with said erecting means.

10. The apparatus of claim 9 wherein said withdrawing means comprises a vacuum operated gripping device.

11. The apparatus of claim 9 wherein said lifting means comprises:

at least a first elongated stop member for engaging a first edge of the uppermost carton blank in a raised stack of blanks, said first elongated stop member having a fixed position; and at least a second movable elongated stop member positioned oppositely with respect to said first stop member, said second stop member being biased against the uppermost carton blank and urging said blank against said fixed stop member whereby said carton blank will be caused to bow away from the next lower carton blank in the stack.

12. The apparatus of claim 9 wherein said lifting means includes:

reciprocal ram means positioned beneath a stack of carton blanks on a carrier for raising the stack of carton blanks from the carrier; and vertically movable elevator means for engaging carton blanks lifted by said ram means.

13. The apparatus of claim 12 wherein the carriers are pallets having an open-work structure which are located on a roller table and wherein said ram means comprises:

a plurality of rams which may be guided between the openings in the pallet and between openings in the roller table on which the pallet is supported.

14. The apparatus of claim 1 wherein said means for transferring articles into an erected carton blank comprises:

conveyor means for delivering the articles to be packaged into registration with a cell on said rotary turret; and means for pushing articles from said conveyor means into an erected carton blank in a cell of said rotary turret.

15. The apparatus of claim 14 wherein said conveyor means includes:

a conveyor belt; and pairs of spacer members extending upwardly from said belt, said spacer member of said pairs defining therebetween cavities for receiving articles to be packaged, said belt being controlled such that articles positioned between said spacer members will be brought into alignment with an article receiving cell in said turret.

16. The apparatus of claim 14 wherein said conveyor means includes:

elevator means for delivering articles to be packaged to said conveyor means at spaced intervals.

17. The apparatus of claim 1 wherein said adhesive applying means comprise movable heads, said heads being displacable both radially and axially relative to a cell of said turret.

18. The apparatus of claim 7 further comprising:

means for delivering carriers supporting a stack of carton blanks to said erecting means, said delivering means including:

means for lifting a stack of carton blanks from a carrier; and means for withdrawing the uppermost carton blank in the stack from said lifting means and transporting the thus withdrawn carton blank into registration with said erecting means.

19. The apparatus of claim 18 wherein said means for erecting a carton blank comprises:

erecting shaft defining means, said shaft defining means having a first vertical wall and a second wall displaced from said first wall and extending obliquely with respect thereto, the gap between said walls at a first end of shaft defined thereby being commensurate with the width of a side of the carton being formed and said gap enlarging in the direction of the opposite end of the shaft; and means for engaging a flattened carton blank supported at said opposite shaft end and drawing said blank downwardly to the bottom of the shaft, the flattened carton blank being forced to assume an erected tubular shape by said downward motion between the converging shaft walls.

20. The apparatus of claim 19 wherein the space between said first and second walls of said shaft defining means is adjustable.

* * * * *